US009073685B2

(12) United States Patent
Ray

(10) Patent No.: US 9,073,685 B2
(45) Date of Patent: Jul. 7, 2015

(54) LIQUID DISPENSER PUMP

(71) Applicant: Eugene W. Ray, Barberton, OH (US)

(72) Inventor: Eugene W. Ray, Barberton, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/733,979

(22) Filed: Jan. 4, 2013

(65) Prior Publication Data

US 2013/0175301 A1 Jul. 11, 2013

Related U.S. Application Data

(60) Provisional application No. 61/583,673, filed on Jan. 6, 2012.

(51) Int. Cl.

| | |
|---|---|
| ***B65D 37/00*** | (2006.01) |
| ***B65D 83/00*** | (2006.01) |
| ***B05B 1/30*** | (2006.01) |
| ***B05B 1/32*** | (2006.01) |
| ***B05B 11/00*** | (2006.01) |
| ***F04B 43/00*** | (2006.01) |

(52) U.S. Cl.

CPC ..... *B65D 83/0094* (2013.01); *B05B 1/306* (2013.01); *B05B 1/326* (2013.01); *B05B 11/0037* (2013.01); *B05B 11/0054* (2013.01); *B05B 11/3035* (2013.01); *B05B 11/3043* (2013.01); *B05B 11/3064* (2013.01); *F04B 43/0054* (2013.01)

(58) Field of Classification Search

CPC .. B65D 83/0094; B65D 83/0072; B67D 3/04; G01F 11/02; G01F 11/08; G01F 11/084; G01F 11/086; G01F 11/088; A47K 5/1208; A47K 5/1209

USPC ..... 222/207, 321.6, 321.7, 321.8, 372, 380, 222/383.1, 633, 107, 566, 451, 453

See application file for complete search history.

(56) References Cited

U.S. PATENT DOCUMENTS

| | | | |
|---|---|---|---|
| 2,107,106 | A | 2/1938 | Crook |
| 2,559,116 | A | 12/1945 | Doschek |

(Continued)

FOREIGN PATENT DOCUMENTS

| | | | |
|---|---|---|---|
| DE | 42403534 | A1 | 8/1993 |
| DE | 202009006603 | U1 | 9/2009 |

(Continued)

OTHER PUBLICATIONS

PCT International Search Report and Written Opinion in Related Application No. PCT/US2013/020079, Dated May 5, 2013.

*Primary Examiner* — J. Casimer Jacyna
*Assistant Examiner* — Benjamin R Shaw
(74) *Attorney, Agent, or Firm* — Calfee, Halter & Griswold LLP

(57) ABSTRACT

Liquid dispenser systems, pumps for use in liquid dispenser systems, and disposable/replaceable liquid container units for use in liquid dispenser systems are disclosed. A refill unit for refilling a liquid dispenser system comprises a container for holding a supply of liquid and a pump connected to the container. The pump comprises a fitment portion configured for attachment to a liquid container, and a pump portion which comprises an upper valve member and a lower valve member disposed along a common longitudinal axis, such that the fitment portion and the pump portion are formed as one integral piece.

17 Claims, 1 Drawing Sheet

(56) References Cited

U.S. PATENT DOCUMENTS

| | | | | |
|---|---|---|---|---|
| 2,824,672 | A | 2/1958 | Wersching | |
| 2,825,492 | A | 3/1958 | Krasno | |
| 2,833,448 | A | 5/1958 | Lerner | |
| 3,128,016 | A | 4/1964 | Ferri, Jr. | |
| 3,155,281 | A | 11/1964 | Stracey | |
| 3,734,350 | A | 5/1973 | Waterman et al. | |
| 3,952,924 | A * | 4/1976 | Benson | 222/181.2 |
| 4,019,663 | A | 4/1977 | Krautkramer | |
| 4,946,075 | A * | 8/1990 | Lundback | 222/181.3 |
| 5,000,215 | A | 3/1991 | Phillips | |
| 5,170,910 | A | 12/1992 | Hamm | |
| 5,353,961 | A | 10/1994 | Debush | |
| 5,518,147 | A * | 5/1996 | Peterson et al. | 222/153.07 |
| 5,524,795 | A * | 6/1996 | Lee | 222/207 |
| 5,664,703 | A * | 9/1997 | Reifenberger et al. | 222/207 |
| 6,241,132 | B1 | 6/2001 | Morrison | |
| 6,273,307 | B1 | 8/2001 | Gross et al. | |
| 6,439,429 | B1 | 8/2002 | Gross | |
| 6,612,466 | B1 * | 9/2003 | Malin | 222/107 |
| 6,805,267 | B2 * | 10/2004 | Bougamont | 222/633 |
| 6,991,140 | B2 * | 1/2006 | Bourque et al. | 222/541.9 |
| 7,246,723 | B2 * | 7/2007 | Santagiuliana | 222/209 |
| 7,461,829 | B2 | 12/2008 | Rule | |
| 7,850,044 | B2 * | 12/2010 | Hildebrand et al. | 222/107 |
| 7,896,202 | B2 | 3/2011 | Greenwald et al. | |
| 2009/0136370 | A1 | 5/2009 | Goodwin | |
| 2009/0166379 | A1 * | 7/2009 | Wright et al. | 222/80 |
| 2010/0301070 | A1 * | 12/2010 | Allef et al. | 222/207 |
| 2010/0327019 | A1 * | 12/2010 | Nilsson | 222/214 |
| 2011/0031278 | A1 * | 2/2011 | Han de Man | 222/207 |
| 2011/0036863 | A1 * | 2/2011 | Nilsson | 222/92 |
| 2011/0132941 | A1 * | 6/2011 | Kim | 222/566 |

FOREIGN PATENT DOCUMENTS

| | | | |
|---|---|---|---|
| DE | 202011105790 | U1 | 12/2011 |
| EP | 2039621 | A2 | 3/2009 |
| FR | 2199588 | A1 | 4/1974 |
| GB | 1593084 | A | 7/1981 |
| GB | 2185292 | A | 7/1987 |
| WO | 2009104992 | A1 | 8/2009 |
| WO | 2011/130763 | A1 | 10/2011 |

* cited by examiner

LIQUID DISPENSER PUMP

CROSS REFERENCE TO RELATED APPLICATIONS

This utility patent application is a non-provisional of and claims priority to and the benefits of U.S. Provisional Patent Application Ser. No. 61/583,673, filed on Jan. 6, 2012, which is also entitled LIQUID DISPENSER PUMP, which is incorporated herein by reference in its entirety.

TECHNICAL FIELD

The present invention relates generally to liquid dispenser systems and more particularly to a liquid pump, as well as a disposable refill/replacement liquid container unit which includes such a pump.

BACKGROUND OF THE INVENTION

Liquid dispenser systems, such as liquid soap and sanitizer dispensers, provide a user with a predetermined amount of liquid upon actuation of the dispenser. Such liquid dispenser systems often include a disposable/replacement liquid container unit which may be easily removed from the system when the liquid container is empty, to be replaced by a filled unit.

SUMMARY

Liquid dispenser systems, pumps for use in liquid dispenser systems and disposable/replaceable liquid container units for use in liquid dispenser systems are disclosed herein. In one embodiment, a refill unit for refilling a liquid dispenser system comprises a container for holding a supply of liquid and a pump connected to the container. The pump comprises a fitment portion configured for attachment to a liquid container and a pump portion which comprises an upper valve member and a lower valve member disposed along a common longitudinal axis, such that the fitment portion and the pump portion are formed as one integral piece.

In this way, a simple and economical liquid dispenser system, as well as a pump and a refill unit, are provided.

BRIEF DESCRIPTION OF THE DRAWINGS

These and other features and advantages of the present invention will become better understood with regard to the following description and accompanying drawings in which.

DETAILED DESCRIPTION

Figure 1:
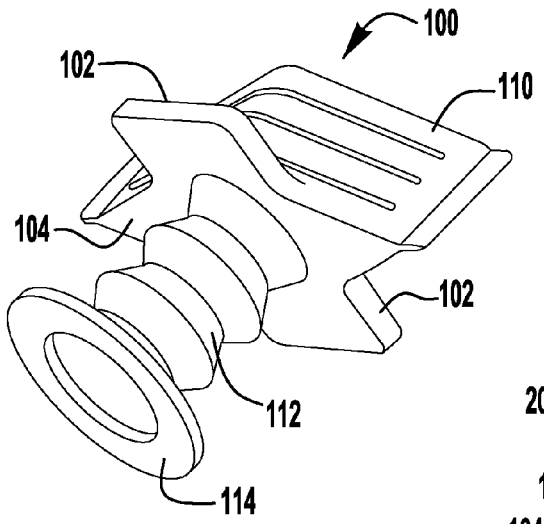
FIG. 1 is a perspective view of a first exemplary embodiment of a liquid pump 100.
Figure 2:
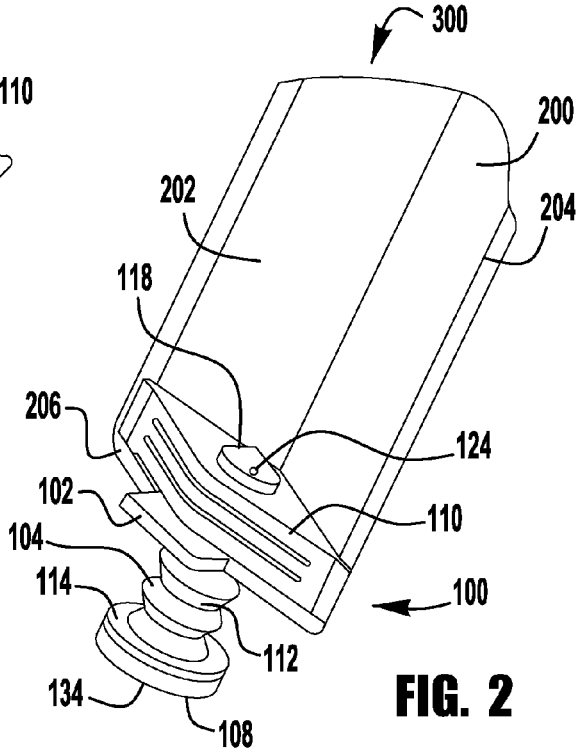
FIG. 2 is a different perspective view of the liquid pump 100 of FIG. 1, attached to a liquid container 200 which is shown in partial cross-section.
Figure 3:
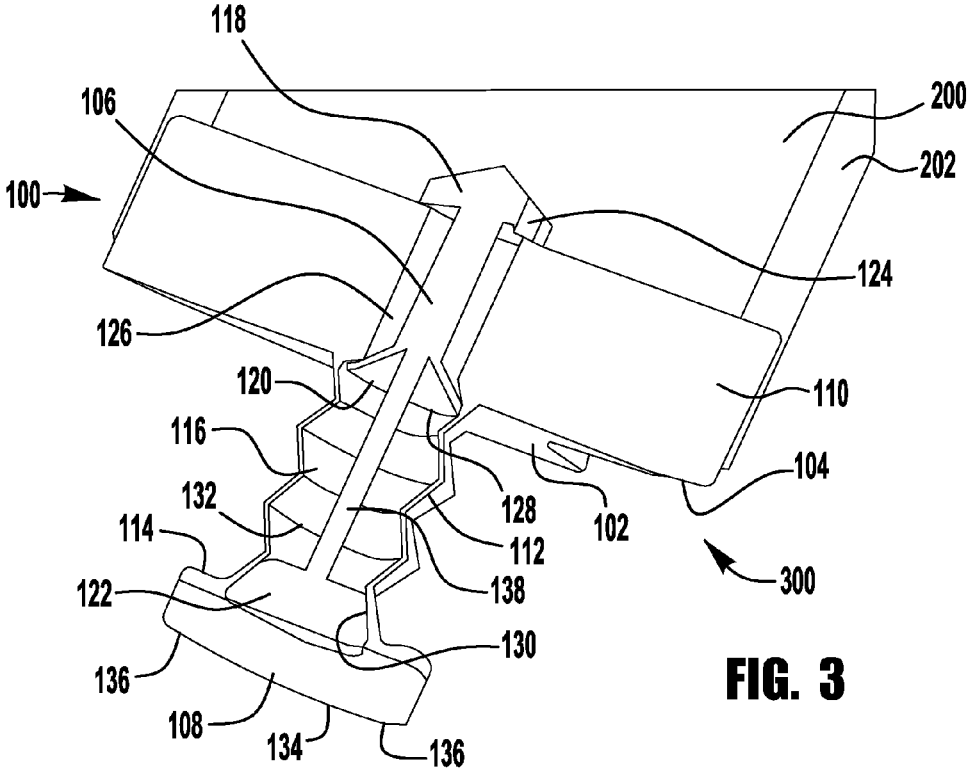
FIG. 3 is a cross-sectional illustration of the liquid pump 100 of FIG. 1, attached to a liquid container 200 which is shown in partial cross-section.

FIGS. 1-3 illustrate a first exemplary embodiment of a liquid pump 100, which in FIGS. 2-3 is shown attached to a liquid container 200. The liquid pump 100 and liquid container 200 together form a disposable/replaceable refill unit 300 which may be used in combination with a dispensing system (not shown). As such, the liquid pump 100 includes two locking members 102, which in this embodiment are in the form of tabs. More generally, the locking members 102 may take any form which allows the liquid pump 100 to be connected to corresponding members in the dispensing system in a secure manner, such as a lock and key fit. In that way, in the event the liquid stored in the chamber 202 of the installed disposable refill unit 300 runs out, or the installed disposable refill unit 300 otherwise has a failure, the installed disposable refill unit 300 may be removed from the liquid dispenser system. The empty or failed disposable refill unit 300 may then be replaced with a new disposable refill unit 300 including a liquid storage chamber 202.

The dispensing system (not shown) includes a housing which contains one or more actuating members (not shown) to activate the liquid pump 100. The liquid dispenser system may be a wall-mounted system, a counter-mounted system, an un-mounted portable system movable from place to place or any other kind of liquid dispenser system. The dispensing system may additionally have other elements, such as a foaming unit which turns the liquid received from the liquid pump 100 into a foam for dispensing to a user.

The liquid container 200 of the disposable refill unit 300 forms a liquid storage chamber 202. The liquid container 200 may be a bag made from a thin plastic material. The liquid storage chamber 202 contains a supply of a liquid within the disposable refill unit 300. In various embodiments, the contained liquid could be for example a soap, a sanitizer, a cleanser, a disinfectant or some other liquid. In the exemplary refill unit 300, the liquid storage chamber is formed by a flexible and collapsible pouch 204. In other embodiments, the liquid storage chamber 202 may be formed by an uncollapsible rigid housing member, a collapsible rigid housing member, or have any other suitable configuration for containing the liquid without leaking. Further, the liquid container 200 may be provided with an air inlet valve (not shown) to prevent creating a vacuum in the chamber 202 as liquid is being dispensed. The liquid container 200 may advantageously be refillable, replaceable or both refillable and replaceable. In other embodiments, the liquid container 200 within the disposable refill unit 300 may be neither refillable nor replaceable.

The exemplary liquid pump 100 is a bellows pump. In other embodiments, the liquid pump may have different means of pumping liquid, such as, for example, a dome pump. The liquid pump 100 is made from any convenient material such as a plastic material; for example, a linear low-density polyethylene (LLDPE). The pump 100 has a housing 104, a valve stem 106 and, optionally, an outlet cap 108. The housing 104 includes a canoe fitment 110, the locking members 102, a bellows 112 and an outlet flange 114, all together in one integral construction. The canoe fitment 110 of the housing 104 is received within a bottom end 206 of the container 200 to form the disposable refill unit 300. The canoe fitment 110 may be attached to the liquid container 200 using any method, such as, for example, ultrasonic welding or heat welding, a press fit connection or a mechanical connection.

In some prior systems, a canoe fitment is manufactured as a separate component from the pump mechanism, and the two are then connected together by a snap-fit or closure interface. Forming these components as one integral construction, as in the exemplary pump 100, is simpler and less expensive than the prior art systems.

The valve stem 106 is disposed within a channel 116 of the housing 104, and may move longitudinally up and down within the channel 116 as described further below. In one embodiment, the valve stem 106 includes a valve cap 118, an upper valve member 120 and a lower valve member 122 as one integral piece. The valve cap 118 extends out of the channel 116 and up into the liquid storage chamber 202 and has an outer periphery which is wider than the width of the channel 116. The valve cap 118 is flexible and resilient, allowing the valve stem 106 to be pushed up through the channel 116 so that the cap 118 compresses and then expands to retain the valve stem 106 within the pump housing 104. One or more passages 124 within the valve cap 118 permit liquid stored within the chamber 202 to flow down into an intermediate chamber 126 of the channel 116, located within the canoe fitment 110 between the valve cap 118 and the upper valve member 120.

The upper valve member 120 of the valve stem 106 may be received within an upper valve seat 128 formed at the intersection between the canoe fitment 110 and the bellows 112. The lower valve member 122 of the valve stem 106 may be received within a lower valve seat 130 formed at the intersection between the bellows 112 and the outlet flange 114. Thus, the bellows 112 defines a bellows chamber 132 of the channel 116 between the two valve members 120 and 122. The upper and lower valves open and close as the valve stem 106 reciprocates up and down within the channel 116, as described further below.

In some embodiments, such as the one in FIGS. 2-3, an outlet cap 108 of the liquid pump 100 is connected to the outlet flange 114 of the housing 104. Other embodiments may not include an outlet cap 108. When used, the bottom surface 134 of the outlet cap 108 contains one or more apertures 136 for dispensing liquid out of the liquid pump 100. In some embodiments, the apertures 136 are simply channels leading out of the outlet cap 108. In other embodiments, the apertures 136 may include one or more one-way check valves to prevent back flow of liquid from outside of the pump 100 back through the apertures 136.

The liquid pump 100 operates as follows. FIG. 3 illustrates the pump 100 in a primed position. In that position, liquid is free to flow under the force of gravity from the liquid storage chamber 202 down into the intermediate chamber 126 through the passages 124 in the valve cap 118. However, liquid within the intermediate chamber 126 is prevented from flowing into the bellows chamber 132 by the closed upper valve member 120 being received within the upper valve seat 128. More specifically, the upper valve member 120 is made from a flexible and resilient material. The upper valve member 120 is resilient enough that it remains in the "closed" position shown in FIG. 3, so long as the only force acting on it is the downward force of gravity by the liquid in the intermediate chamber 126. However, the upper valve member 120 is flexible enough so that when a suction force is applied by the bellows chamber 132 underneath the member 120, the member 120 will separate from the upper valve seat 128 and permit liquid to flow from the intermediate chamber 126 into the bellows chamber 132.

Still describing the primed position of FIG. 3, the lower valve member 122 of the valve stem 106 is received within the lower valve seat 130. In that way, a supply of liquid is trapped within the bellows chamber 132 between the two valve members 120 and 122, and is prevented from leaking out of the refill unit 300. The lower valve member 122 may be biased to its closed position in any number of ways. In one embodiment, the lower stem portion 138 of the valve stem 106 may be elastically stretched in the closed position of FIG. 3, so that the lower valve member 122 is held firmly against the lower valve seat 130. In other embodiments, a separate biasing member (not shown) such as a coil spring may instead or in addition be used to help bias the lower valve member 122 into the closed position. The natural resiliency of the bellows 112 expanding itself to an extended position may also help to create a seal at the lower valve. The biasing mechanism(s) hold the lower valve member 122 in the closed position of FIG. 3 at all times, except when liquid is being dispensed out of the pump 100.

Although not shown in the Figures, the liquid dispenser system in which the liquid pump 100 is situated has a pump actuator mechanism. There are many different kinds of pump actuators which may be employed in the liquid dispenser system. The pump actuator of the liquid dispenser system may be any type of actuator, such as, for example, a manual lever, a manual pull bar, a manual push bar, a manual rotatable crank, an electrically-activated actuator, or other means for actuating the liquid pump 100 within the liquid dispenser system. Electronic pump actuators may additionally include a motion detector to provide for a hands-free dispenser system with touchless operation.

Various mechanical and/or electronic intermediate linkages connect an external actuator member to an internal actuator member (all not shown). A user operates the external actuator in order to actuate the pump 100. As a result, the internal actuator member exerts a force on the outlet flange 114 of the liquid pump 100, perhaps via an outlet cap 108 if used, to move it upwardly toward the liquid container 200. The interface between the locking members 102 and the liquid dispenser system holds the canoe fitment 110 firmly in place, so that the bellows 112 contracts as the outlet flange 114 is forced upward.

As the bellows 112 contracts, the upper valve member 120 remains in the closed position of FIG. 3, which has two consequences. First, it continues to prevent the liquid within the intermediate chamber 126 from flowing down into the bellows chamber 132. Second, due to the contracting bellows chamber 132, the liquid which is already disposed within the bellows chamber 132 is forced past the closed biasing of the lower valve member 122 to be dispensed. The internal actuator stops the upward movement of the outlet flange 114 when the bellows 112 reaches a fully contracted position, or has contracted far enough to dispense a desired amount of liquid.

When a desired amount of liquid has been dispensed, the internal actuator stops the upward movement of the outlet flange 114. At that time, the outlet flange 114 is free to move downwardly back to the primed position shown in FIG. 3. Such movement may occur due to the natural resiliency of the bellows 112 extending to that position, or under the forceful direction of the internal actuator, or by a separate biasing member such as a coil spring, or some other means.

As the bellows 112 expands, a vacuum suction force is generated within the bellows chamber 132 by the closed lower valve member 122. That force is sufficient to overcome the cracking pressure or resiliency of the upper valve member 120 and separate it from the upper valve seat 128. Thus, during the downward stroke, liquid passes from the intermediate chamber 126 down into the bellows chamber 132. Once the downward stroke ends, returning the pump 100 to the primed configuration of FIG. 3, the vacuum suction force ceases. At that time, the upper valve member 120 returns to its resting and closed position shown in FIG. 3. Thus, the pump 100 is ready for another actuation.

As just described, in the specific embodiment of FIG. 3, the valve stem 106 which includes the valve cap 118, the upper valve member 120 and the lower valve member 122 is formed of one integral construction. In an alternative embodiment (not shown), the valves may be formed by an assembly of one or more separate pieces. As one example, such a valve assembly may be comprised of two pieces, an inner valve stem **106*a* and an outer valve sheath 106*b*. The inner valve stem 106*a* includes the lower valve member 122 and the lower stem portion 138. The outer valve stem 106***b* includes the valve cap 118, the upper valve member 120, and an intermediate body which has a central channel to slidably receive the lower stem portion 138. The inner valve stem 106*a* slides up and down in the outer valve sheath 106*b* and the channel 116 to operate the pump, while the sheath 106*b* remains stationary within the channel 116.

More specifically, when the internal actuator initially moves the outer flange 114 upwardly to operate the pump, the inner valve stem 106*a* remains in place within the channel 116. As a result, the stationary lower valve member 122 is separated from the upwardly moving lower valve seat 130. In that way, the lower valve is opened to permit liquid to flow downwardly out of the bellows chamber 132. If an outlet cap 108 is employed, the liquid can then exit the pump through the apertures 136 in the bottom surface 134 of the outlet cap 108.

Eventually, the outer flange 114 is moved far enough upwardly that the bottom surface 134 of the outlet cap 108 contacts the lower valve member 122 of the inner valve stem 106*a*. Further upward movement of the outlet flange 114 continues to contract the bellows 112, but also moves the inner valve stem 106*a* upwardly within the outer valve sheath 106*b* and the channel 116. The lower stem portion 138 of the inner valve stem 106*a* may be short enough that its upper end always remains disposed within the outer valve sheath 106*b*. Alternatively, the lower stem portion 138 may extend upwardly out of the outer valve sheath 106*b* and into the liquid storage chamber 202. In such a case, the valve stem 106*a* may include a seal to prevent liquid from flowing from chamber 202*a* past valve stem 106*a*.

When a desired amount of liquid has been dispensed, the internal actuator stops the upward movement of the outlet flange 114, which is then free to move downwardly back to the primed position shown in FIG. 3. During the initial downward and expanding movement of the bellows 112, the inner valve stem 106*a* remains in an upper position within the outer valve sheath 106*b* and the channel 116. As a result, the stationary lower valve member 122 comes into contact with the downwardly moving lower valve seat 130. In that way, the lower valve is closed to prevent liquid and air from flowing past the lower valve. Further downward movement of the outlet flange 114 continues to expand the bellows 112, but also moves the inner valve stem 106*a* downwardly within the outer valve sheath 106*b* and the channel 116, which creates a vacuum to refill bellows chamber 132. Once the downward stroke ends, the pump 100 returns to the primed configuration of FIG. 3, and the pump is ready for another actuation.

If an outlet cap 108 is used in conjunction with an inner valve stem 106*a* and an outer valve sheath 106*b*, the apertures 136 may be disposed outside of the periphery of the lower valve member 122. In other embodiments using an outlet cap 108, the apertures 136 may instead or additionally be placed in the center area of the bottom surface 134. In such an embodiment, the valve surface of the lower valve member 122 may also have apertures, so that liquid may reach the central apertures 136 when the lower valve member 122 is contacting the bottom surface 134. When the lower valve is closed as shown in FIG. 3, the apertures within the lower valve member 122 are closed off by the lower valve seat 130.

The rest position of the embodiment shown in FIGS. 1-3 is a primed pump. In yet other alternative embodiments (not shown), the rest position may be an unprimed state, such that actuation both primes the pump and then dispenses the primed liquid.

In the embodiment of FIGS. 1-3, the passages 124 in the valve cap 118 are wide enough that liquid is free to move from the liquid storage chamber 202 to the intermediate chamber 126 at all times. In an alternative embodiment (not shown), the passages 124 may be small enough that the surface tension of the liquid in chamber 202 prevents the liquid from flowing down into the intermediate chamber 126 by the force of gravity alone. In some such embodiments, the passages 124 may function as the upper valve, so that the upper valve member 120 may not be needed. That is, the surface tension of the liquid in the chamber 202 keeps the liquid there until the bellows 112 expands in a downward stroke, creating a vacuum suction force to overcome the surface tension.

The liquid pump 100 of FIGS. 1-3, or any other liquid pump embodiment disclosed herein, may be manufactured in any number of ways. As one example, the housing 104 and the valve stem 106 may be separately molded from suitable plastic material(s). Then the valve stem 106 may be inserted into the channel 116 of the housing 104, because the valve cap 118 resiliently collapses as it passes through the channel 116 and then expands when it exits the channel 116 to hold the valve stem 106 in place. Then the outlet cap 108, if desired, may be placed on the housing 104.

The liquid pump 100 may be attached to a filled liquid container 200 in any number of ways. As one example, the pump housing 104 may be first attached to the container 200, which is then filled through the channel 116 before the valve stem 106 is inserted. Or, the pump 100 may be manufactured entirely separately from the container 200 and then attached thereto, before filling the container with liquid from an open top end which is then welded or otherwise sealed shut. As yet another option, the liquid container 200 may be filled with liquid and then held upside-down as a completed pump assembly 100 is attached to the container at its bottom end 206.

The exemplary liquid pump 100 may allow for a simple and inexpensive replacement of the liquid supply in a liquid dispenser system. Once the supply of liquid in the liquid storage chamber 202 runs out, the now-empty disposable refill unit 300 may be replaced with a new refill unit 300 containing a supply of liquid.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. For example, in a very simple embodiment, what has been described above as a refill unit 300 for use in conjunction with a separate liquid dispensing system may instead be used alone as the entire pumping system. The locking members 102 may simply be received in a mounting bracket, and the pump 100 actuated by a user pressing his or her hand on the outlet flange 114 to dispense liquid. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the general inventive concept.

I claim:

1. A refill unit for a liquid dispenser system, the refill unit comprising:

a liquid container for holding a supply of liquid; and a pump connected to the liquid container, the pump comprising a fitment portion and a pump portion, wherein the fitment portion is configured for attachment to the liquid container, and the pump portion comprises an upper valve member and a lower valve member disposed along a common longitudinal axis;

wherein the fitment portion and the pump portion are formed as one integral piece;

wherein the substantially all of the pumping action occurs when the pump portion extends and contracts lengthwise along the longitudinal axis to pump liquid;

wherein the upper valve and the lower valve are connected to each other by a resilient member.

2. The refill unit of claim 1 wherein the pump portion comprises a bellows.

3. The refill unit of claim 1 wherein the upper valve and the lower valve are formed of one integral piece.

4. The refill unit of claim 1 wherein the upper valve and the lower valve are separate pieces but are connected to each other.

5. The refill unit of claim 1 further comprising an outlet cap.

6. The refill unit of claim 1 wherein the liquid container is in the form of a plastic bag.

7. The refill unit of claim 1 wherein the fitment further comprises one or more locking tabs.

8. A pump comprising:

a unitary pump body including a fitment portion and a bellows portion;

a substantially straight passage extending through the pump body;

the passage having a proximal inlet end near the fitment portion and a distal outlet end opposite the fitment portion; and an inlet valve located near the proximal inlet end and an outlet valve located near the distal outlet end;

wherein the inlet valve and the outlet valve extend along a common longitudinal axis;

wherein substantially all of the pumping action occurs when the pump body extends and contracts lengthwise along the longitudinal axis to pump liquid; and wherein the inlet valve and the outlet valve are joined to one another by a resilient member.

9. The pump of claim 8 wherein the inlet valve and the outlet valve are connected to each other.

10. The pump of claim 8 further comprising a container secured to the pump.

11. The pump of claim 8 further comprising a valve cap, wherein the valve cap, the inlet valve and the outlet valve are linked together.

12. The pump of claim 8 wherein the inlet valve and outlet valve are joined together by one or more pieces.

13. A refill unit comprising:

a container;

a unitary pump body including a fitment portion and a bellows portion;

the fitment portion connected to the container;

a substantially straight channel extending through the pump body;

a valve stem located at least partially within the substantially straight channel; and the valve stem including an inlet valve member, an outlet valve member, and a stem connecting the inlet valve member to the outlet valve member; and wherein substantially all of the pumping action occurs when the unitary pump body extends and contracts lengthwise along the longitudinal axis to pump liquid.

14. The refill unit of claim 13 wherein the stem is a resilient member.

15. The refill unit of claim 13 wherein the stem is formed of two or more pieces.

16. The refill unit of claim 13 further comprising one or more apertures in the valve cap for fluid to flow through.

17. The refill unit of claim 13 further comprising an intermediary chamber located between the valve cap and the upper valve member.

* * * * *